US008358119B2

(12) United States Patent
Kim

(10) Patent No.: US 8,358,119 B2
(45) Date of Patent: Jan. 22, 2013

(54) CURRENT REFERENCE CIRCUIT UTILIZING A CURRENT REPLICATION CIRCUIT

(75) Inventor: Hyoung-Rae Kim, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 334 days.

(21) Appl. No.: 12/859,335

(22) Filed: Aug. 19, 2010

(65) Prior Publication Data

US 2011/0043185 A1 Feb. 24, 2011

(30) Foreign Application Priority Data

Aug. 19, 2009 (KR) ..... 10-2009-0076635

(51) Int. Cl.
*G05F 3/16* (2006.01)
*G05F 3/20* (2006.01)

(52) U.S. Cl. ..... 323/313; 323/314; 323/315; 323/907; 327/538; 327/539; 327/540

(58) Field of Classification Search ..... 323/313, 323/314, 315, 907; 327/538, 539, 540
See application file for complete search history.

(56) References Cited

U.S. PATENT DOCUMENTS 5,900,772 A * 5/1999 Somerville et al. ..... 327/539
5,936,392 A * 8/1999 Taylor ..... 323/315
6,891,358 B2 * 5/2005 Marinca ..... 323/316
6,969,982 B1 * 11/2005 Caldwell ..... 323/313
7,119,527 B2 * 10/2006 Fernald ..... 323/315
7,543,253 B2 * 6/2009 Marinca et al. ..... 323/313
7,791,401 B1 * 9/2010 Chiu ..... 327/513
2004/0124822 A1 * 7/2004 Marinca ..... 323/313
2006/0001412 A1 * 1/2006 Fernald ..... 323/313
2006/0061412 A1 * 3/2006 Molina et al. ..... 327/539
2009/0295360 A1 * 12/2009 Hellums ..... 323/315

FOREIGN PATENT DOCUMENTS

JP 2007-172153 7/2007
KR 100712555 B1 4/2007
KR 1020080070194 A 7/2008

* cited by examiner

*Primary Examiner* — Bao Q Vu
(74) *Attorney, Agent, or Firm* — Volentine & Whitt, PLLC

(57) ABSTRACT

A current reference circuit includes a proportional-to-absolute temperature (PTAT) current generator, a band-gap reference circuit and a current replication circuit. The PTAT generator generates a PTAT current. The band-gap reference circuit generates a reference voltage based on the PTAT current and generates a second current by cancelling a first current from the PTAT current. The first current has a zero temperature coefficient and the second current has a positive temperature coefficient. The current replication circuit replicates the first current based on the PTAT current and the second current.

15 Claims, 11 Drawing Sheets

CURRENT REFERENCE CIRCUIT UTILIZING A CURRENT REPLICATION CIRCUIT

CROSS-REFERENCE TO RELATED APPLICATION

A claim of priority under 35 USC §119 is made to Korean Patent Application No. 2009-0076635, filed on Aug. 19, 2009 in the Korean Intellectual Property Office (KIPO), the contents of which are herein incorporated by reference in their entirety.

BACKGROUND

Example embodiments relate to a current reference circuit, and more particularly to a current reference circuit which exhibits favorable temperature-dependency and voltage-dependency characteristics.

A bias circuit, commonly included among the analog circuitry of an integrated circuit, function to set an operating reference of the analog circuitry. For example, a current reference circuit, which functions as a constant current source, is used to set operational characteristics of an operational amplifier, such as direct current (DC) operational characteristic and alternating current (AC) operational characteristic.

A conventional current reference circuit may be substantially influenced by changes in temperature, voltage (e.g., power supply voltage) and manufacturing process variables. As such, additional circuitry is adopted in a conventional current reference circuit reduce influences such as temperature-dependency and voltage-dependency. This additional circuit can increase the size and power consumption of the current reference circuit.

SUMMARY

According to some example embodiments, a current reference circuit includes a proportional-to-absolute temperature (PTAT) current generator, a band-gap reference circuit and a current replication circuit. The PTAT generator generates a PTAT current. The band-gap reference circuit generates a reference voltage based on the PTAT current and generates a second current by cancelling a first current from the PTAT current. The first current has a zero temperature coefficient and the second current has a positive temperature coefficient. The current replication circuit replicates the first current based on the PTAT current and the second current.

In some embodiments, current reference circuit may further include a start-up circuit which starts up the PTAT current generator, the band-gap reference generator and the current replication circuit.

BRIEF DESCRIPTION OF THE DRAWINGS

Illustrative, non-limiting example embodiments will be more clearly understood from the detailed description that follows when taken in conjunction with the accompanying drawings.

DETAILED DESCRIPTION OF THE EMBODIMENTS

Figure 1:
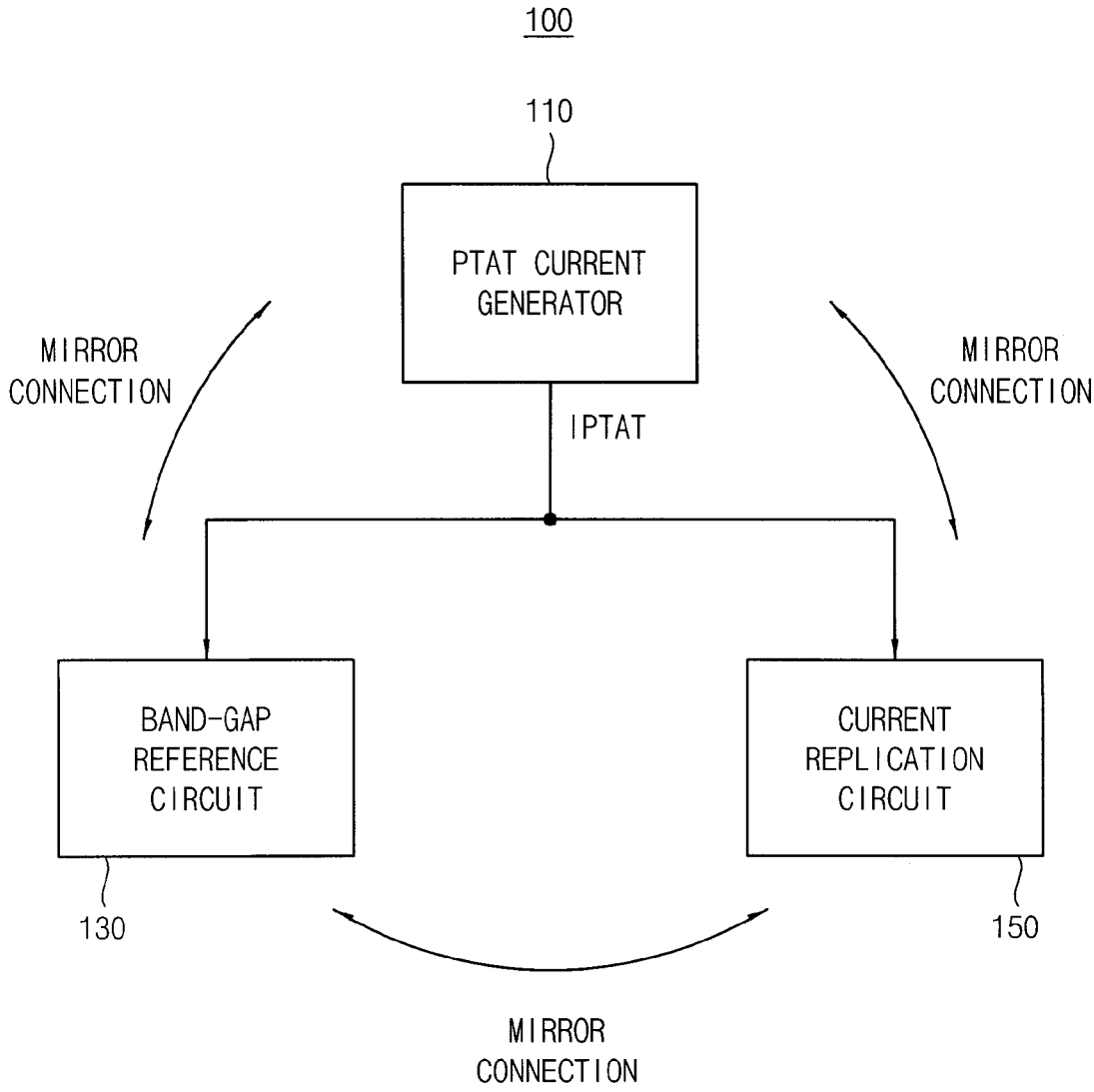
FIG. 1 is a block diagram illustrating a current reference circuit according to some example embodiments.

Various example embodiments will be described more fully with reference to the accompanying drawings, in which embodiments are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a current reference circuit 100 according to some example embodiments.

Referring to FIG. 1, the current reference circuit 100 includes a proportional-to-absolute temperature (PTAT) current generator 110, a band-gap reference circuit 130 and a current replication circuit 150.

The PTAT current generator 110 generates a proportional-to-absolute temperature (PTAT) current IPTAT. The band-gap reference circuit 130 generates a reference voltage based on the PTAT current IPTAT and generates a second current IPTC by cancelling a first current IZTC from the PTAT current IPTAT. The first current IZTC has a zero temperature coefficient (ZTC) and the second current IPTC has a positive temperature coefficient (PTC). The current replication circuit 150 replicates the first current IZTC based on the PTAT current IPTAT and the second current IPTC. The current replication circuit 150 may replicate the first current IZTC by subtracting the second current IPTC from the PTAT current IPTAT.

As will be described later, each of the band-gap reference circuit 130 and the current replication circuit 150 may be connected to the PTAT current generator 110 in a current mirror configuration to duplicate the PTAT current IPTAT. The current replication circuit 150 may be connected to the band-gap reference circuit 130 in the current mirror configuration to duplicate the second current IPTC. For example, a first metal oxide semiconductor (MOS) transistor included in the PTAT current generator 110 may be connected to the second MOS transistor included in the band-gap reference circuit 130 in the form of a current mirror (i.e., mirror connection). The first MOS transistor included in the PTAT current generator 110 may be connected to a third MOS transistor included in the current replication circuit 150 in the form of the current mirror. In addition, the second MOS transistor included in the band-gap reference circuit 130 may be connected to the third MOS transistor included in the current replication circuit 150 in the form of the current mirror.

Figure 2:
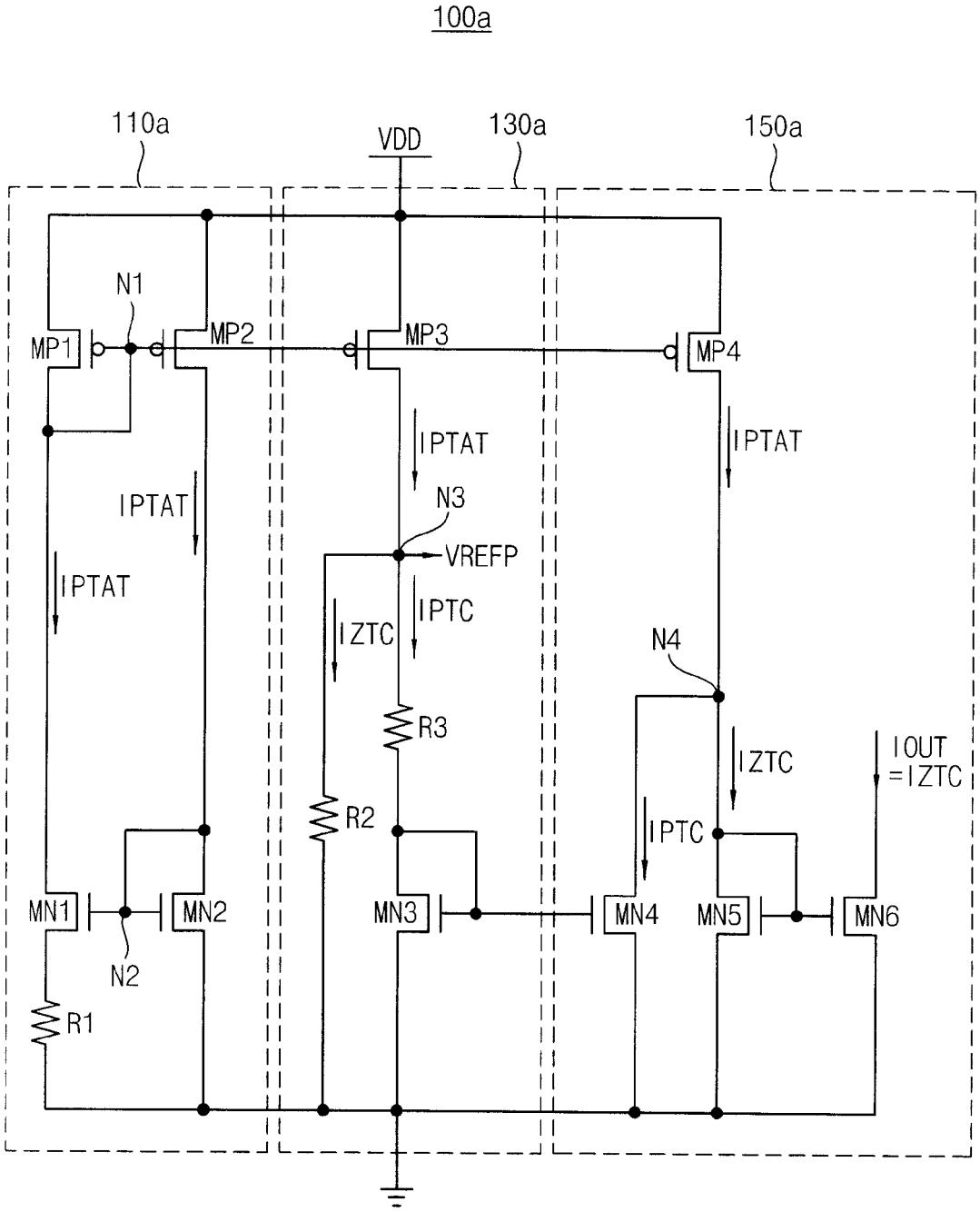
FIG. 2 is a circuit diagram illustrating a current reference circuit according to an example embodiment.

FIG. 2 is a circuit diagram illustrating a current reference circuit 100*a* according to an example embodiment.

Referring to FIG. 2, the current reference circuit 100*a* includes a PTAT current generator 110*a*, a band-gap reference circuit 130*a* and a current replication circuit 150*a*.

In the specific example of this embodiment, the PTAT current generator 110*a* includes a first p-type metal oxide semiconductor (PMOS) transistor MP1, a second PMOS transistor MP2, a first n-type metal oxide semiconductor (NMOS) MN1, a second NMOS transistor MN2 and a first resistor R1. The first PMOS transistor MP1 has a first electrode (for example, a source) connected to a power supply voltage VDD, a gate connected to a first node N1 and a second electrode (for example, a drain). The second electrode and the gate of the first PMOS transistor MP1 are commonly connected to the first node N1. The second PMOS transistor MP2 has a first electrode (for example, a source) connected to the power supply voltage VDD, a gate connected to the first node N1 and a second electrode (for example, a drain). The first NMOS transistor MN1 has a first electrode (for example, a drain) connected to the second electrode of the first PMOS transistor MP1 (i.e., the first node N1), a gate connected to a second node N2 and a second electrode (for example, a source). The second NMOS transistor MN2 has a first electrode (for example, a drain) connected to the second end of the second PMOS transistor MP2, a gate connected to the second node N2 and a second electrode (for example, a source) connected to a ground voltage. The first electrode and the gate of the second NMOS transistor MN2 are commonly connected to the second node N2. The first resistor R1 is connected between the second electrode of the first NMOS transistor MN1 and the ground voltage. Since the first and second PMOS transistors MP1 and MP2 form a current mirror configuration and the first and second NMOS transistors MN1 and MN2 form another current mirror configuration, the PTAT current IPTAT flows through two current paths, respectively. In other words, the PTAT current IPTAT flows through the second NMOS transistor MN2, and the PTAT current IPTAT also flows through the first NMOS transistor MN1 and the first resistor R1.

The band-gap reference circuit 130*a* of this specific example includes a third PMOS transistor MP3, a third NMOS transistor MN3, a second resistor R2 and a third resistor R3.

The third PMOS transistor MP3 is connected to the first PMOS transistor MP1 in the form of a current mirror. The third PMOS transistor MP3 has a first electrode (for example, a source) connected to the power supply voltage VDD, a gate connected to the first node N1 and a second electrode (for example, a drain) connected to a third node N3. The second resistor R2 is connected between the third node N3 and the ground voltage. The third resistor R3 has a first electrode connected to the third node N3. The third NMOS transistor MN3 has a first electrode (for example, a drain) connected to a second electrode of the third resistor R3, a second electrode (for example, a source) connected to the ground voltage and a gate. The first electrode and the gate of the third NMOS transistor MN3 are commonly connected to at the second electrode of the third resistor R3. The PTAT current IPTAT flows through a branch connected between the second electrode of the third PMOS transistor MP3 and the third node N3. Since the first PMOS transistor MP1 and the third PMOS transistor MP3 form a current mirror configuration, the PTAT current IPTAT flows through the third PMOS transistor MP3, which is divided into the first current IZTC and the second current IPTC at the third node N3. In other words, the first current IZTC flows through the second resistor R2 and the second current IPTC flows through the third resistor R3.

The current replication circuit 150*a* of this specific example includes a fourth PMOS transistor MP4, a fourth NMOS transistor MN4, a fifth NMOS transistor MN5 and a sixth NMOS transistor MN6.

The fourth PMOS transistor MP4 is connected to the first PMOS transistor MP1 in the form of a current mirror. The fourth PMOS transistor MP4 has a first electrode (for example, a source) connected to the power supply voltage VDD, a gate connected to the first node N1 and a second electrode (for example, a drain) connected to a fourth node N4. The fourth NMOS transistor MN4 has a first electrode (for example, a drain) connected to the fourth node N4, a gate connected to the gate of the third NMOS transistor MN3 and a second electrode (for example, a source) connected to the ground voltage. The fifth NMOS transistor MN5 has a first electrode (for example, a drain) connected to the fourth node N4, a second electrode (for example, a source) connected to the ground voltage and a gate. The first electrode and the gate of the fifth NMOS transistor MN5 are commonly connected to the fourth node N4. The sixth NMOS transistor MN6 has a first electrode (for example, a drain), a gate connected to the gate of the fifth NMOS transistor MN5 and a second electrode (for example, a source) connected to the ground voltage. Since the first PMOS transistor MP1 and the forth PMOS transistor MP4 form a current mirror configuration, the PTAT current IPTAT flows through the fourth PMOS transistor MP4, which is divided into the first current IZTC and the second current IPTC at the fourth node N4. Since the third NMOS transistor MN3 and the fourth transistor MN4 form another current mirror configuration, the second current IPTC flows through the fourth NMOS transistor MN4 and thus the first current IZTC flows through the fifth NMOS transistor MN5. The first current IZTC is flows from the fourth node N4 to the first electrode of the fifth NMOS transistor MN5. An output current IOUT, which is substantially the same as the first current IZTC, flows through the sixth NMOS transistor MN6.

Figure 3A:
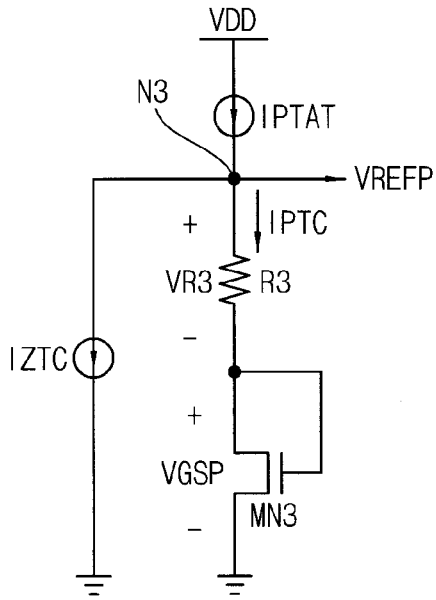
FIG. 3A is a circuit diagram illustrating an equivalent circuit of a band-gap reference circuit included in the current reference circuit of FIG. 2.
Figure 3B:
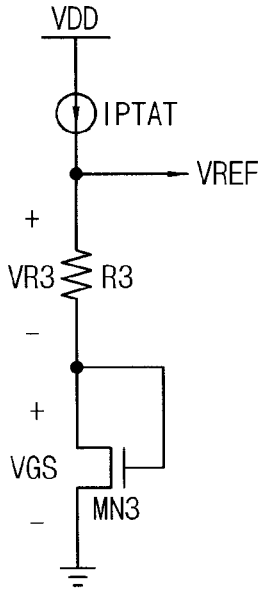
FIG. 3B is a circuit diagram illustrating an equivalent circuit of a conventional band-gap reference circuit.
Figure 3C:
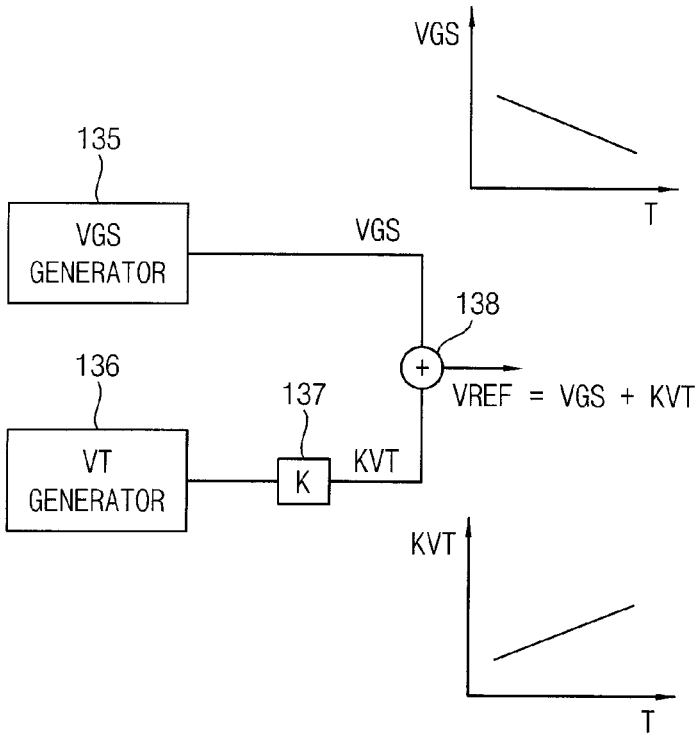
FIG. 3C is a diagram for describing an operation of the band-gap reference circuit.
Figure 4:
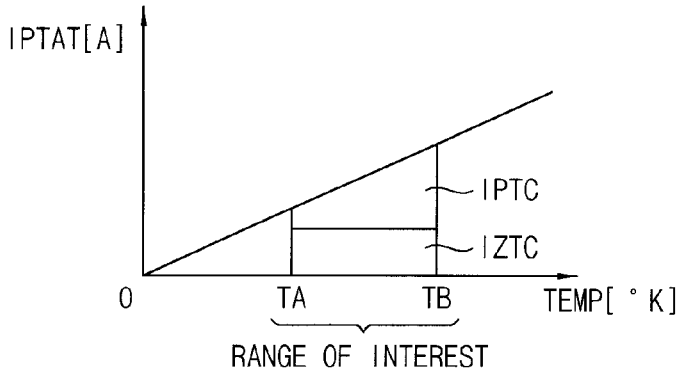
FIG. 4 is a graph illustrating a configuration of a proportional-to-absolute temperature (PTAT) current.

FIG. 3A is a circuit diagram illustrating an equivalent circuit of the band-gap reference circuit 130*a* included in the current reference circuit 100*a* of FIG. 2. FIG. 3B is a circuit diagram illustrating an equivalent circuit of a conventional band-gap reference circuit. FIG. 3C is a diagram for describing an operation of the band-gap reference circuit. FIG. 4 is a graph illustrating a configuration of the PTAT current IPTAT. Referring to FIG. 4, the PTAT current IPTAT includes the first current IZTC having the zero temperature coefficient (ZTC) and the second current IPTC having the positive temperature coefficient (PTC).

Hereinafter, an operation of the current reference circuit 100*a* according to the example embodiments will be described with reference to FIG. 1 through FIG. 4.

If it is assumed that the amount of current generated in space-charge regions in a MOS transistor may be neglected, the channel length of the MOS transistor is sufficiently long, the density of surface states of the MOS transistor and the change of surface potential energy of the MOS transistor may be neglected, and a level of a drain to source voltage of the MOS transistor is sufficiently higher than a level of a thermal voltage, then a current-voltage (I-V) characteristic of a n-channel MOS transistor in a weak inversion region may be similar to a I-V characteristic of a bipolar junction transistor. For example, the I-V characteristic of the n-channel MOS transistor may be represented by Equation 1.

$$ID=ID0\times\times e^{q(VGS-Vth)/nkT} \quad \text{Equation 1}$$

In the Equation 1, ID0 represents an initiation current (e.g., a constant), S represents a valid width to a valid channel length of the MOS transistor, q represents the charge amount of a single charge, k represents the Boltzmann constant, T represents the absolute temperature, VGS represents a gate to source voltage of the MOS transistor and Vth represents a threshold voltage of the MOS transistor. In the Equation 1, (ID0×S) may be substituted with IS which represents a saturation current.

From Equation 1, the gate to source voltage VGS of the MOS transistor may be represented by Equation 2, $$VGS = n \times VT \times \ln\frac{ID}{S \times ID0} + Vth \quad \text{Equation 2}$$

In the Equation 2, VT represents the thermal voltage of the MOS transistor. A value of the thermal voltage VT may be substantially the same as a value of kT/q. A temperature coefficient of the gate to source voltage VGS (i.e., ∂VGS/∂T) may have a negative value. For example, the temperature coefficient of the gate to source voltage VGS may be about −1,061 ppm/° C. Thus, the gate to source voltage VGS may be proportional to the absolute temperature in the weak inversion region.

In FIG. 3C, a band-gap reference voltage VREF may be calculated by abstracting the gate to source voltage VGS to a voltage KVT that is proportional to the thermal voltage VT. FIG. 3B illustrates the conventional band-gap reference circuit that generates the band-gap reference voltage VREF based on the gate to source voltage VGS and the voltage in proportion to the thermal voltage VT. In FIG. 3B, a gate to source voltage VGS of an NMOS transistor MN3 that is connected in the form of a diode between a resistor R3 and a ground voltage (i.e., the gate and one of the electrodes of the transistor MN3 are electrically connected to each other) may be represented by Equation 3.

$$VGS = n \times VT \times \ln\frac{IPTAT}{S \times ID0} + Vth \quad \text{Equation 3}$$

The band-gap reference voltage VREF may be represented by Equation 4.

$$VREF=VGS+IPTAT\times R3 \quad \text{Equation 4}$$

In the Equation 4, R3 represents a resistance of the resistor R3. A level of the band-gap reference voltage VREF generated by the conventional band-gap reference circuit of FIG. 3B may be a voltage level of energy band-gap of silicon, i.e., about 1.2V. Thus, the conventional band-gap reference circuit of FIG. 3B does not operate if a level of the power supply voltage VDD is lower than about 1V.

As illustrated in FIG. 4, the PTAT current IPTAT includes the first current IZTC having the zero temperature coefficient (ZTC) and the second current IPTC having the positive temperature coefficient (PTC) within a range of interest.

The band-gap reference circuit according to the example embodiments is illustrated in FIG. 3A. The band-gap reference circuit of FIG. 3A may be used for enhancing a range of an operating voltage of the conventional band-gap reference circuit of FIG. 3B and may correspond to the band-gap reference circuit 130*a* included in FIG. 2. Compared with the conventional band-gap reference circuit of FIG. 3B, the band-gap reference circuit of FIG. 3A further includes a current source that generates the first current IZTC and is connected to the node N3.

In the band-gap reference circuit of FIG. 3A, a gate to source voltage VGSP of the third NMOS transistor MN3 may be represented by Equation 5.

$$VGSP = n \times VT \times \ln\frac{IPTC}{S \times ID0} + Vth \quad \text{Equation 5}$$

The second current IPTC may be generated by subtracting the first current IZTC from the PTAT current IPTAT, and thus the Equation 5 may be substituted with Equation 6.

$$VGSP = n \times VT \times \ln\frac{IPTAT - IZTC}{S \times ID0} + Vth \quad \text{Equation 6}$$

Thus, a level of the gate to source voltage VGSP of the third NMOS transistor included in the band-gap reference circuit of FIG. 3A may be lower than a level of the gate to source voltage VGS of the NMOS transistor MN3 included in the conventional band-gap reference circuit of FIG. 3B.

A reference voltage VREFP of the band-gap reference circuit of FIG. 3A may be represented by Equation 7.

$$VREFP=VGSP+IPTC\times R3=VGSP+(IPTAT-IZTC)\times R3 \quad \text{Equation 7}$$

Thus, a level of the reference voltage VREFP of the band-gap reference circuit of FIG. 3A may be lower than about 1V and the band-gap reference circuit of FIG. 3A may be considered a low voltage band-gap reference circuit.

Referring back to FIG. 2, the current reference circuit 100*a* includes the PTAT current generator 110*a*, the band-gap reference circuit 130*a* and the current replication circuit 150*a*.

The PTAT current generator 110*a* generates the PTAT current IPTAT that is variable in proportion to the absolute temperature. If a size ratio of the first NMOS transistor MN1 to the second NMOS transistor MN2 is K, the PTAT current IPTAT may be represented by Equation 8.

$$IPTAT=\frac{n\times VT}{R1}\times \ln K \quad \text{Equation 8}$$

Referring to the band-gap reference circuit 130*a* included in the current reference circuit 100*a* of FIG. 2, the first current IZTC having the zero temperature coefficient (ZTC) may be represented by Equation 9.

$$IZTC=\frac{VREFP}{R2} \quad \text{Equation 9}$$

When the Equation 9 is substituted into Equation 7, the reference voltage VREFP of the band-gap reference circuit 130*a* according to the example embodiment may be represented by Equation 10.

$$VREFP=\frac{R2}{R2+R3}(VGSP+IPTAT\times R3) \quad \text{Equation 10}$$

Thus, the band-gap reference circuit 130*a* according to the example embodiment may generate the reference voltage VREFP having a level which is lower than the level of the reference voltage VREF of the conventional band-gap reference circuit of FIG. 3B, by adjusting resistances of the second resistor R2 and the third resistor R3.

Based on the Equation 9 and the Equation 10, the first current IZTC having the zero temperature coefficient (ZTC) may be represented by Equation 11.

$$IZTC=\frac{VREFP}{R2}=\frac{1}{R2+R3}(VGSP+IPTAT\times R3) \quad \text{Equation 11}$$

The current replication circuit 150*a* may be used for outputting the first current IZTC. The current replication circuit 150*a* is connected to the band-gap reference circuit 130*a* in the form of a current mirror and generates the first current IZTC by subtracting the second current IPTC from the PTAT current IPTAT. The first current has the zero temperature coefficient (ZTC) and the second current has the positive temperature coefficient (PCT). The first current is output through the sixth NMOS transistor MN6 that is connected to the fifth NMOS transistor MN5 in the form of a current mirror.

Figure 5:
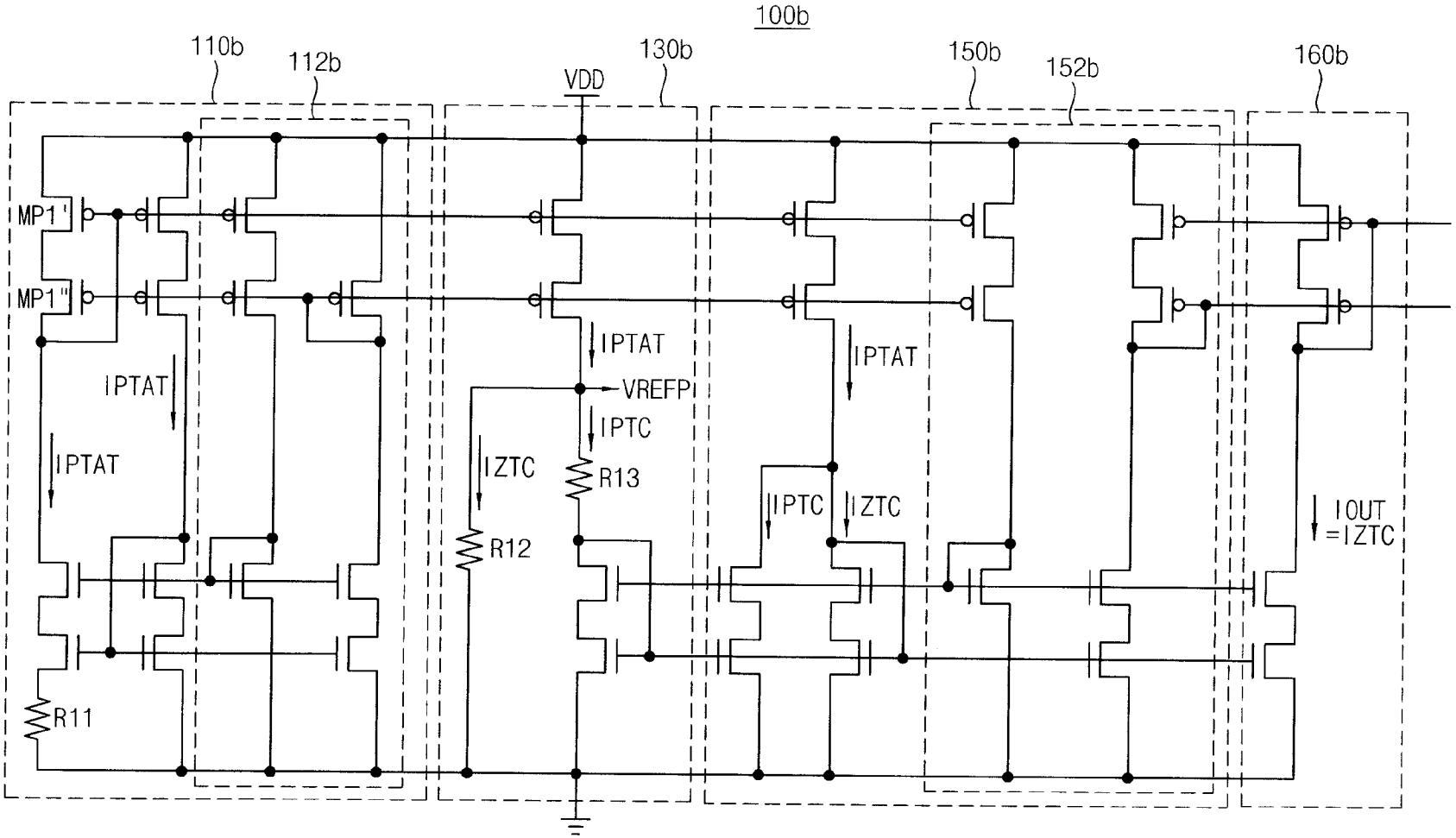
FIG. 5 is a circuit diagram illustrating a current reference circuit according to another example embodiment.
Figure 6:
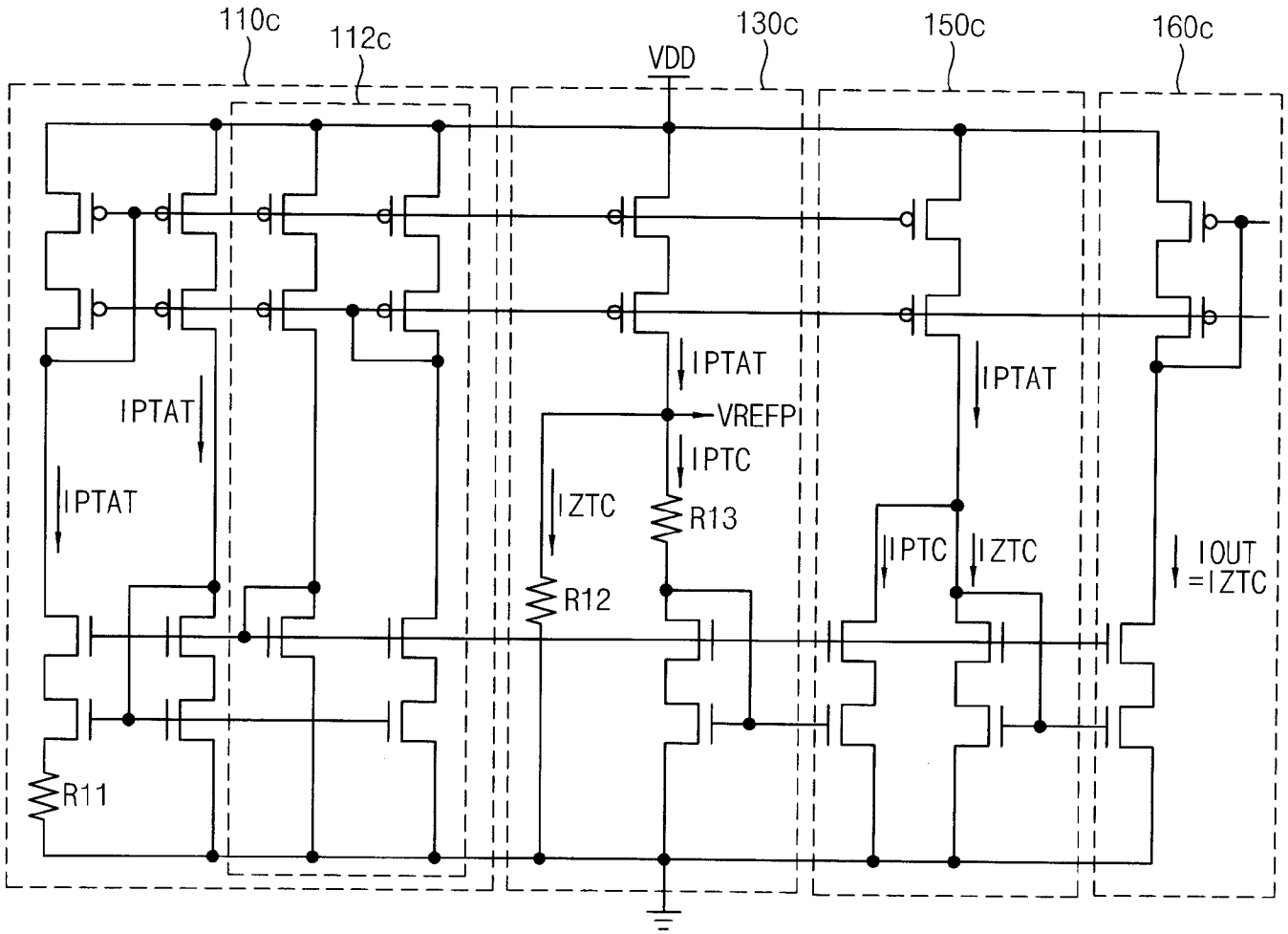
FIG. 6 is a circuit diagram illustrating a current reference circuit according to still another example embodiment.
Figure 7:
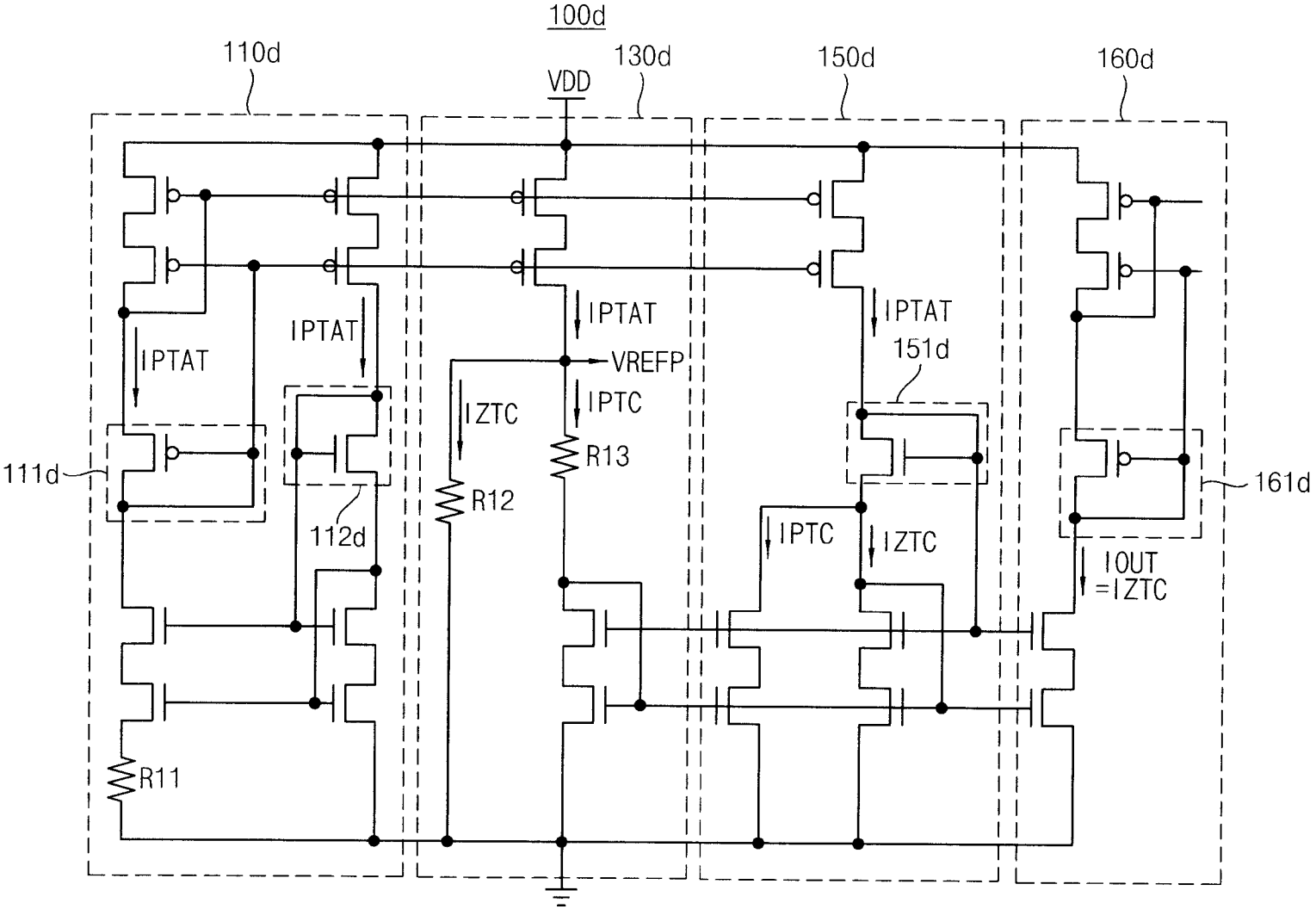
FIG. 7 is a circuit diagram illustrating a current reference circuit according to still another example embodiment.

FIG. 5 is a circuit diagram illustrating a current reference circuit 100*b* according to another example embodiment. FIG. 6 is a circuit diagram illustrating a current reference circuit 100*c* according to still another example embodiment. FIG. 7 is a circuit diagram illustrating a current reference circuit 100*d* according to still another example embodiment.

The current reference circuits 100*b*, 100*c* and 100*d* may include a plurality of cascode-connected MOS transistor pairs for reducing voltage dependency. For example, the current reference circuit 100*b* may include a first cascode-connected PMOS transistor pair MP1' and MP1' that corresponds to a first PMOS transistor MP1 included in FIG. 2. The PMOS transistors MP1' and MP1' are cascode-connected.

Referring to FIG. 5, the current reference circuit 100*b* of this example includes a PTAT current generator 110*b*, a band-gap reference circuit 130*b*, a current replication circuit 150*b* and an output circuit 160*b*. The current reference circuit 100*b* may further include a first bias circuit 112*b* and a second bias circuit 152*b*. The first bias circuit 112*b* may stably bias the PTAT current generator 110*b*. The second bias circuit may stably bias the band-gap reference circuit 130*b* and the current replication circuit 150*b*. An operation of the current reference circuit 100*b* of FIG. 5 is substantially the same as the operation of the current reference circuit 100*a* of FIG. 2.

Referring to FIG. 6, the current reference circuit 100*c* of this example includes a PTAT current generator 110*c*, a band-gap reference circuit 130*c*, a current replication circuit 150*c* and an output circuit 160*c*. The current reference circuit 100*c* may further include a bias circuit 112*c*. The bias circuit 112*c* may stably bias the PTAT current generator 110*c*, the band-gap reference circuit 130*c* and the current replication circuit 150*c*. Thus, the current reference circuit 100*c* of FIG. 6 may have a simple structure because the current reference circuit 100*c* includes a single bias circuit 112*c* for biasing the PTAT current generator 110*c*, the band-gap reference circuit 130*c* and the current replication circuit 150*c*. An operation of the current reference circuit 100*c* of FIG. 6 is substantially the same as the operation of the current reference circuit 100*a* of FIG. 2.

Referring to FIG. 7, the current reference circuit 100*d* of this example includes a PTAT current generator 110*d*, a band-gap reference circuit 130*d*, a current replication circuit 150*d* and an output circuit 160*d*. The PTAT current generator 110*d*, the band-gap reference circuit 130*d* and the current replication circuit 150*d* may perform self-biasing operations without including additional bias circuits. For example, the PTAT current generator 110*d* may perform the self-biasing operation by using a PMOS transistor 111*d* and a NMOS transistor 112*d* included in the PTAT current generator 110*d*. The band-gap reference circuit 130*d* and the current replication circuit 150*d* may perform the self-biasing operations by using a NMOS transistor 151*d* included in the current replication circuit 150*d*. The output circuit 160*d* may perform the self-biasing operation by using a PMOS transistor 161*d* included in the output circuit 161*d*. Each of the PMOS transistors 111*d* and 161*d* and the NMOS transistors 112*d* and 151*d* are connected in the form of the diode.

Thus, the current reference circuit 100*d* of FIG. 7 may have a simple structure because the current reference circuit 100*d* does not include additional bias circuits for biasing the PTAT current generator 110*c*, the band-gap reference circuit 130*c* and the current replication circuit 150*c*, but instead performs self-bias operations. An operation of the current reference circuit 100*d* of FIG. 7 is substantially the same as the operation of the current reference circuit 100*a* of FIG. 2.

The current reference circuits 100*b*, 100*c* and 100*d* of FIG. 5 through FIG. 7 according to the example embodiments may output reference currents having a relatively low voltage dependency.

Figure 8:
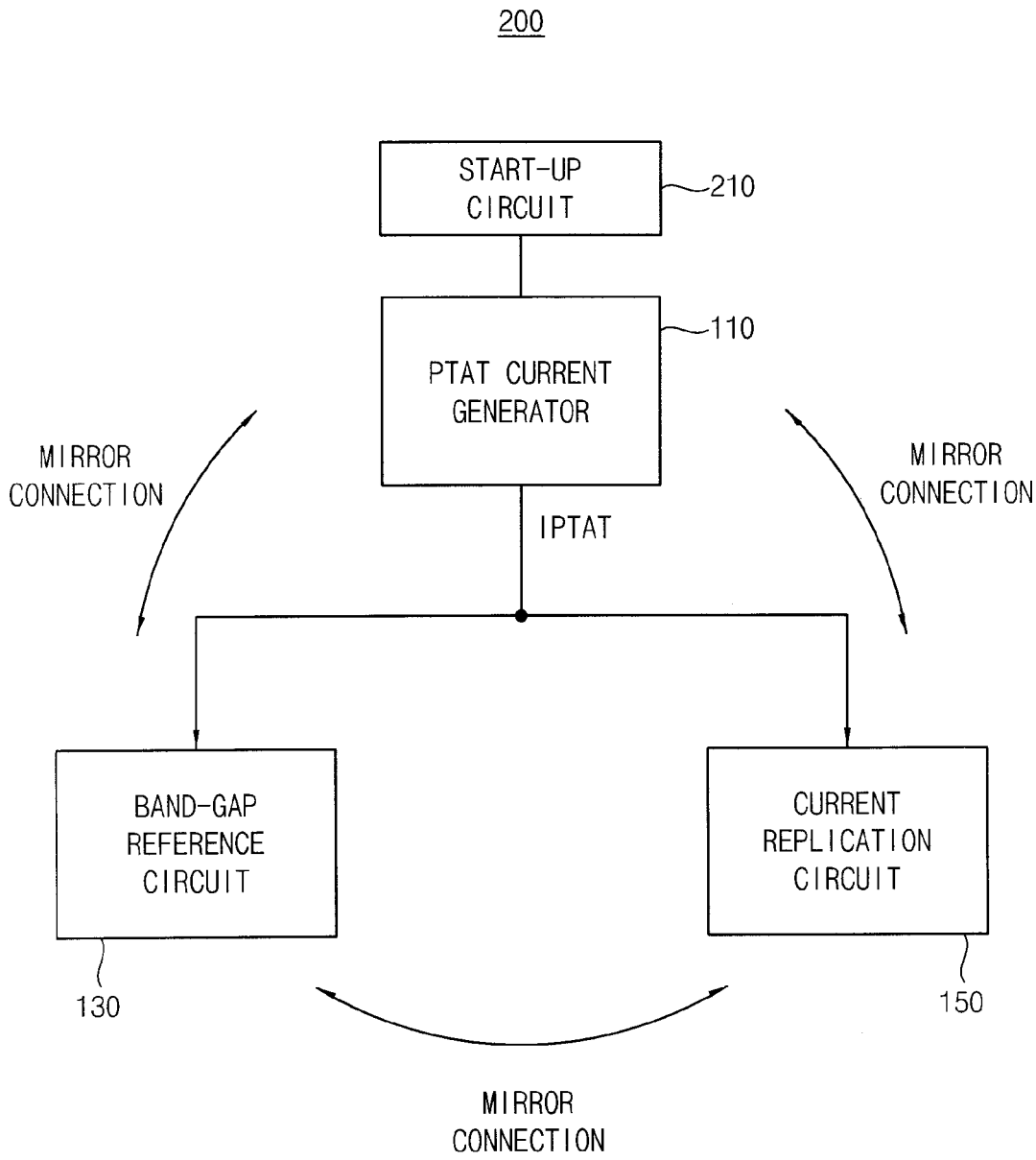
FIG. 8 is a block diagram illustrating a current reference circuit according to additional example embodiments.

FIG. 8 is a block diagram illustrating a current reference circuit 200 according to additional example embodiments.

Referring to FIG. 8, the current reference circuit 200 includes a proportional-to-absolute temperature (PTAT) current generator 110, a band-gap reference circuit 130, a current replication circuit 150 and a start-up circuit 210.

The PTAT current generator 110 generates a PTAT current IPTAT. The band-gap reference circuit 130 generates a reference voltage based on the PTAT current IPTAT and generates a second current IPTC by cancelling a first current IZTC from the PTAT current IPTAT. The first current IZTC has a zero temperature coefficient (ZTC) and the second current IPTC has a positive temperature coefficient (PTC). The current replication circuit 150 replicates the first current IZTC based on the PTAT current IPTAT and the second current IPTC. The start-up circuit 210 starts up the PTAT current generator 110, the band-gap reference generator 130 and the current replication circuit. The current replication circuit 150 may replicate the first current IZTC by subtracting the second current IPTC from the PTAT current IPTAT.

Each of the band-gap reference circuit 130 and the current replication circuit 150 may be connected to the PTAT current generator 110 in a current mirror configuration to duplicate the PTAT current IPTAT. The current replication circuit 150 may be connected to the band-gap reference circuit 130 in the current mirror configuration to duplicate the second current IPTC. For example, a first metal oxide semiconductor (MOS) transistor included in The PTAT current generator 110 may be connected to the second MOS transistor included in the band-gap reference circuit 130 in a form of a current mirror. The first MOS transistor included in the PTAT current generator 110 may be connected to a third MOS transistor included in the current replication circuit 150 in the form of a current mirror. In addition, the second MOS transistor included in the band-gap reference circuit 130 may be connected to the third MOS transistor included in the current replication circuit 150 in the form of the current mirror.

Figure 9:
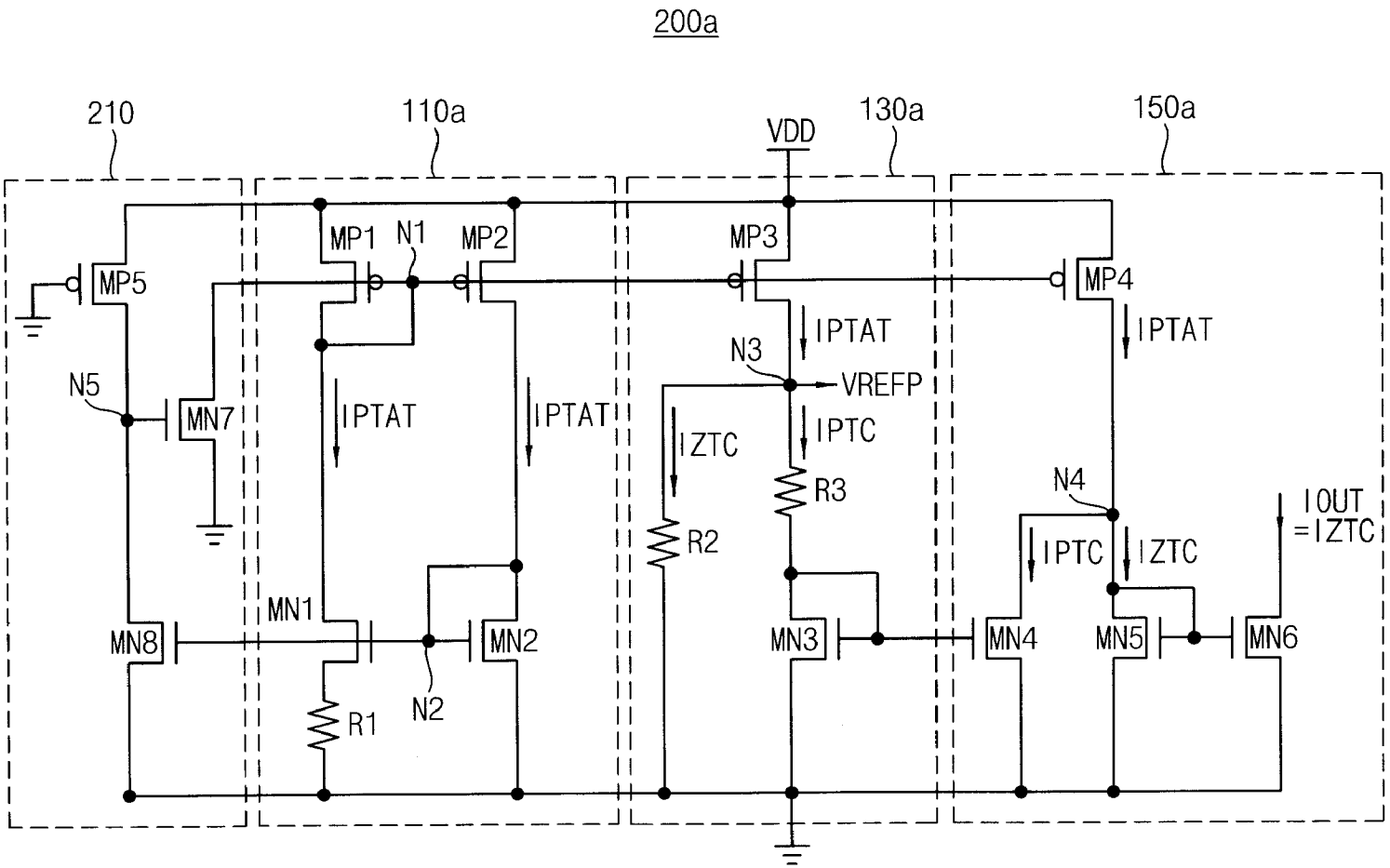
FIG. 9 is a circuit diagram illustrating a current reference circuit according to an example embodiment.

FIG. 9 is a circuit diagram illustrating a current reference circuit 200*a* according to an example embodiment.

Referring to FIG. 9, the current reference circuit 200*a* of this example includes a PTAT current generator 110*a*, a band-gap reference circuit 130*a*, a current replication circuit 150*a* and a start-up circuit 210.

Configurations and operations of the PTAT current generator 110*a*, the band-gap reference circuit 130*a* and the current replication circuit 150*a* included in the current reference circuit 200*a* of FIG. 9 are substantially the same as the configurations and the operations of the PTAT current generator 110*a*, the band-gap reference circuit 130*a* and the current replication circuit 150*a* of previously described FIG. 2, respectively.

The start-up circuit 210 may include a fifth PMOS transistor MP5, a seventh NMOS transistor MN7 and an eighth transistor MN8.

The fifth PMOS transistor MP5 has a first electrode (for example, a source) connected to the power supply voltage VDD, a gate connected to the ground voltage and a second electrode (for example, a drain) connected a fifth node N5. The seventh NMOS transistor has a first electrode (for example, a drain) connected the first node N1, a gate connected to the fifth node N5 and a second electrode (for example, a source) connected to the ground voltage. The eighth NMOS transistor MN8 has a first electrode (for example, a drain) connected to the fifth node N5, a gate connected to the second node N2 and a second electrode (for example, a source) connected to the ground voltage.

In an initial operation of the current reference circuit 200*a*, when the power supply voltage VDD sufficiently increases, the fifth transistor MP5 is turned on, a voltage at the fifth node N5 and a voltage at the first node N1 increase, and the PMOS transistors MP1, MP2, MP3 and MP4 are turned on. Thus, the PTAT current generator 110*a*, the band-gap reference generator 130*a* and the current replication circuit 150*a* may be started up.

Figure 10A:
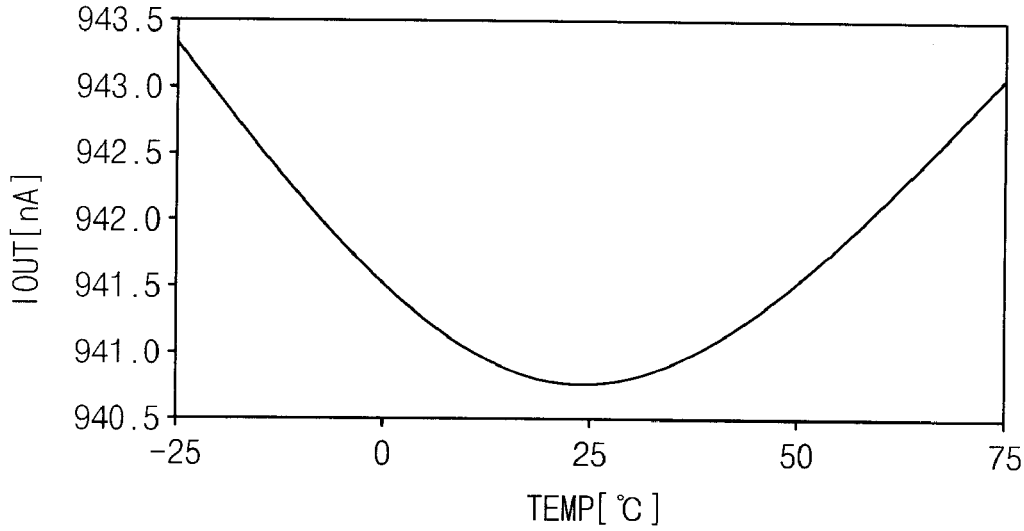
FIG. 10A is a graph illustrating a variation of an output current of the current reference circuit of FIG. 2.
Figure 10B:
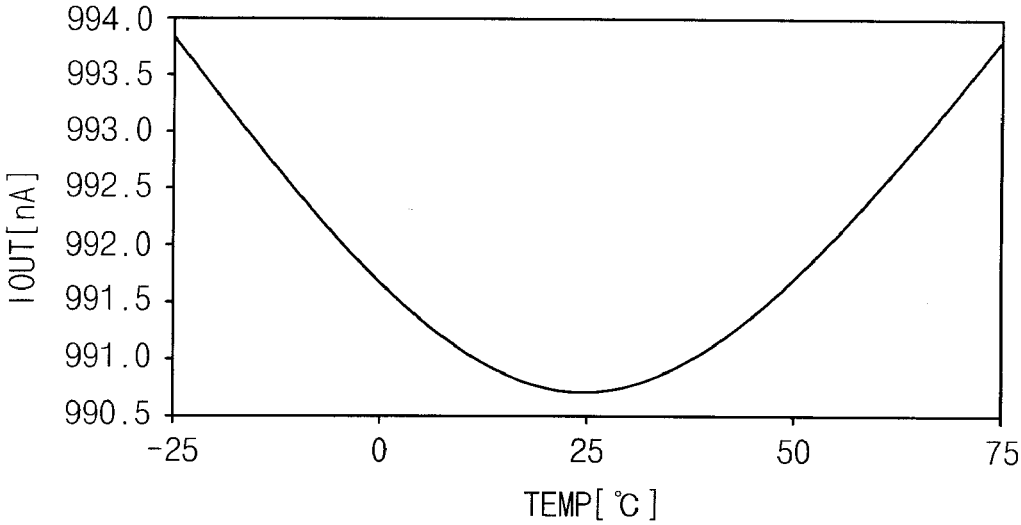
FIG. 10B is a graph illustrating a variation of an output current of the current reference circuit of FIG. 6.

FIG. 10A is a graph illustrating a variation of the output current IOUT of the current reference circuit 100*a* of FIG. 2. FIG. 10B is a graph illustrating a variation of the output current IOUT of the current reference circuit 100*c* of FIG. 6. FIGS. 10A and 10B illustrate the variations of the output currents IOUT when the temperature changes from about −25° C. to about 75° C. The output current IOUT may be substantially the same as the first current IZTC.

Referring to FIG. 10A, a level of the output current IOUT of the current reference circuit 100*a* is about 941nA at about 23° C. A drift of the output current IOUT of the current reference circuit 100*a* is about 2.76 nA within temperature range from about −25° C. to about 75° C. That is, a temperature drift of the output current IOUT of the current reference circuit 100*a* is about 29.3 ppm/° C.

Referring to FIG. 10B, a level of the output current IOUT of the current reference circuit 100*c* is about 991 nA at about 20° C. A drift of the output current IOUT of the current reference circuit 100*c* is about 3 nA within temperature range from about −25° C. to about 75° C. That is, a temperature drift of the output current IOUT of the current reference circuit 100*c* is about 30 ppm/° C.

Thus, referring to FIGS. 10A and 10B, the current reference circuit 100*a* of FIG. 2 and the current reference circuit 100*c* of FIG. 6 may generate the output currents IOUT having relatively low temperature drifts.

Figure 11:
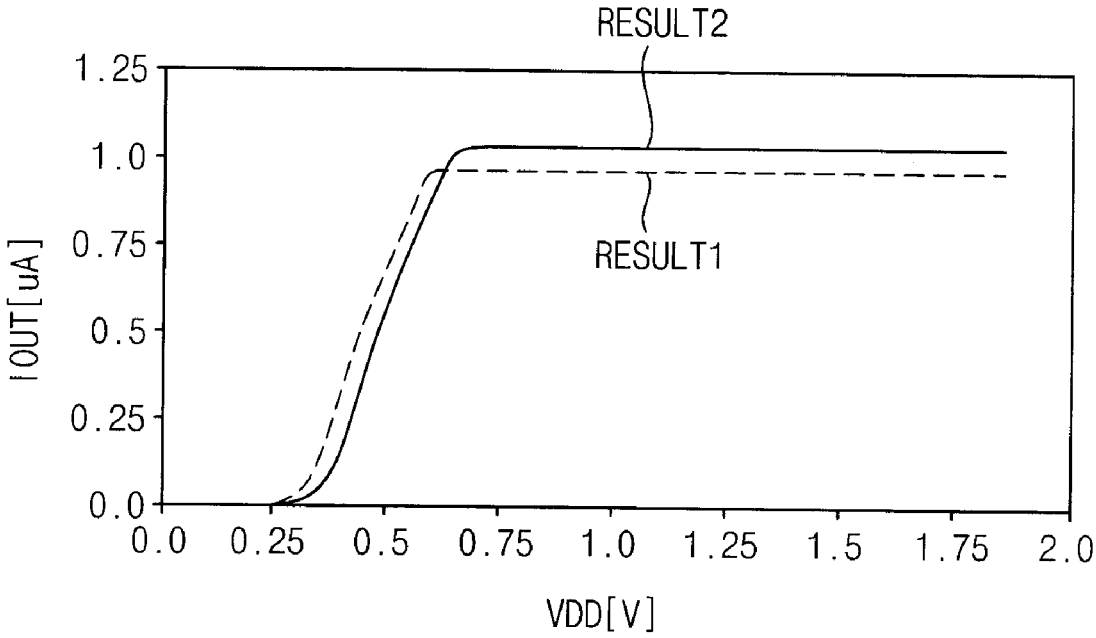
FIG. 11 is a graph illustrating a variation of the output current of the current reference circuit of FIG. 2 and a variation of the output current of the current reference circuit of FIG. 6.

FIG. 11 is a graph illustrating a variation of the output current IOUT of the current reference circuit 100*a* of FIG. 2 and a variation of the output current IOUT of the current reference circuit 100*c* of FIG. 6. FIG. 11 illustrates the variations of the output currents IOUT when the power supply voltage VDD changes from about 0V to about 1.75V.

Referring to FIG. 11, RESULT1 indicates the variation of the output current IOUT of the current reference circuit 100*a* of FIG. 2 and RESULT2 indicates the variation of the output current IOUT of the current reference circuit 100*c* of FIG. 6. A minimum power supply voltage of the current reference circuit 100*a* may be about 0.7V and a power supply voltage dependency of the current reference circuit 100*a* may be about 26116 ppm/V. A minimum power supply voltage of the current reference circuit 100*c* may be about 0.85V and a power supply voltage dependency of the current reference circuit 100*c* may be about 1856 ppm/V.

Thus, the minimum power supply voltage of the current reference circuit 100*a* is lower than the minimum power supply voltage of the current reference circuit 100*c*. The power supply voltage dependency of the current reference circuit 100*c* is lower than the power supply voltage dependency of the current reference circuit 100*a*.

As described above, the current reference circuit according to the example embodiments may be used in integrated circuits. Particularly, the current reference circuit according to the example embodiments may be used in analog integrated circuits that require a constant current source.

While the example embodiments and their advantages have been described in detail, it should be understood that various changes, substitutions and alterations may be made herein without departing from the scope of the inventive concept.

What is claimed is:

1. A current reference circuit comprising:

a proportional-to-absolute temperature (PTAT) current generator configured to generate a PTAT current;

a band-gap reference circuit configured to generate a reference voltage based on the PTAT current and configured to generate a second current by cancelling a first current from the PTAT current, the first current having a zero temperature coefficient and the second current having a positive temperature coefficient; and a current replication circuit configured to replicate the first current based on the PTAT current and the second current.

2. The current reference circuit of claim 1, wherein each of the band-gap reference circuit and the current replication circuit is connected to the PTAT current generator in a current mirror configuration to duplicate the PTAT current.

3. The current reference circuit of claim 2, wherein the current replication circuit is connected to the band-gap reference circuit in a current mirror configuration to duplicate the second current.

4. The current reference circuit of claim 1, wherein the current replication circuit replicates the first current by subtracting the second current from the PTAT current.

5. The current reference circuit of claim 1, wherein the PTAT current generator includes:

a first p-type metal oxide semiconductor (PMOS) transistor having a first electrode connected to a power supply voltage, and a second electrode and a gate commonly connected to a first node;

a second PMOS transistor having a first electrode connected to the power supply voltage, a gate connected to the first node, and a second electrode connected to a second node;

a first n-type metal oxide semiconductor (NMOS) transistor having a first electrode connected to the first node, and a gate connected to the second node;

a second NMOS transistor having a first electrode and a gate commonly connected to the second electrode of the second PMOS transistor, and a second electrode connected to a ground voltage; and a first resistor connected between a second electrode of the first NMOS transistor and the ground voltage.

6. The current reference circuit of claim 5, wherein the band-gap reference circuit includes:

a third PMOS transistor, connected to the first PMOS transistor in a form of a current mirror, which has a first electrode connected to the power supply voltage, a gate connected to the first node, and a second electrode connected to a third node;

a second resistor connected between the third node and the ground voltage;

a third resistor having a first electrode connected to the third node; and a third NMOS transistor having a first electrode and a gate commonly connected to a second electrode of the third resistor, and a second electrode connected to the ground voltage.

7. The current reference circuit of claim 6, wherein the current replication circuit includes:

a fourth PMOS transistor, connected to the first PMOS transistor in the form of the current mirror, which has a first electrode connected to the power supply voltage, a gate connected to the first node, and a second electrode connected to a fourth node;

a fourth NMOS transistor having a first electrode connected to the fourth node, a gate connected to the gate of the third NMOS transistor, and a second electrode connected to the ground voltage;

a fifth NMOS transistor having a first electrode and a gate commonly connected to the fourth node, and a second electrode connected to the ground voltage; and a sixth NMOS transistor having a gate connected to the gate of the fifth NMOS transistor, and a first electrode connected to the ground voltage.

8. The current reference circuit of claim 1, wherein each of the PTAT current generator, the band-gap reference circuit and the current replication circuit includes a plurality of cascode-connected MOS transistor pairs.

9. The current reference circuit of claim 8, further comprising:

a first bias circuit configured to bias the cascode-connected MOS transistor pairs included in the PTAT current generator; and a second bias circuit configured to bias the cascode-connected MOS transistor pairs included in the band-gap reference circuit and the current replication circuit.

10. The current reference circuit of claim 8, further comprising:

a bias circuit configured to bias the cascode-connected MOS transistor pairs included in the PTAT current generator, the band-gap reference circuit and the current replication circuit.

11. The current reference circuit of claim 8, wherein each of the PTAT current generator, the band-gap reference circuit and the current replication circuit performs self-biasing operations.

12. The current reference circuit of claim 1, further comprising:

a start-up circuit configured to start up the PTAT current generator, the band-gap reference generator and the current replication circuit.

13. The current reference circuit of claim 12, wherein the start-up circuit includes:

a first PMOS transistor having a first electrode connected to a power supply voltage, a gate connected to a ground voltage, and a second electrode connected a first node;

a first NMOS transistor having a first electrode connected a second node, a gate connected to the first node, and a second electrode connected to the ground voltage; and a second NMOS transistor having a first electrode connected to the first node, a gate connected to a third node, and a second electrode connected to the ground voltage.

14. The current reference circuit of claim 7, further comprising:

a start-up circuit configured to start up the PTAT current generator, the band-gap reference generator and the current replication circuit.

15. The current reference circuit of claim 14, wherein the start-up circuit includes:

a fifth PMOS transistor having a first electrode connected to a power supply voltage, a gate connected to the ground voltage, and a second electrode connected a fifth node;

a seventh NMOS transistor having a first electrode connected the first node, a gate connected to the fifth node, and a second electrode connected to the ground voltage; and an eighth NMOS transistor having a first electrode connected to the fifth node, a gate connected to the second node, and a second electrode connected to the ground voltage.

* * * * *